United States Patent [19]

Oliana

[11] Patent Number: 4,944,171

[45] Date of Patent: Jul. 31, 1990

[54] TEMPORARY SUPPORT STRUCTURE, PARTICULARLY FOR EMERGENCY KEYS

[76] Inventor: Pierluigi Oliana, Via Redipuglia 13, 31015 Conegliano, Italy

[21] Appl. No.: 305,326

[22] Filed: Feb. 2, 1989

[30] Foreign Application Priority Data

Feb. 11, 1988 [IT] Italy ..... 82511 A/88

[51] Int. Cl.[5] ..... A47G 29/10

[52] U.S. Cl. ..... 70/456 R; 70/458

[58] Field of Search ..... 70/456 R–460

[56] References Cited

U.S. PATENT DOCUMENTS

| | | | |
|---|---|---|---|
| 3,349,589 | 10/1967 | Fricke | 70/456 R |
| 3,394,565 | 7/1968 | Turman | 70/456 R X |
| 3,456,464 | 7/1969 | Levine | 70/456 R |
| 3,481,168 | 12/1969 | Unter | 70/458 X |
| 3,606,777 | 9/1971 | Watson | 70/456 R X |
| 3,797,291 | 3/1974 | Simorghi | 70/456 R X |
| 3,933,017 | 1/1976 | Shee | 70/456 R |
| 4,102,166 | 7/1978 | Hughes | 70/456 R |
| 4,619,125 | 10/1986 | Choi | 70/460 |
| 4,637,236 | 1/1987 | Almblad | 70/458 |
| 4,677,835 | 7/1987 | Almblad | 70/456 R |

*Primary Examiner*—Robert L. Wolfe
*Assistant Examiner*—Suzanne L. Dino
*Attorney, Agent, or Firm*—Guido Modiano; Albert Josif

[57] ABSTRACT

The structure is constituted by at least one planar base having one or more seats for the key and one or more means for temporary hooking to grip elements provided at least on the head of the key. Advantageously, the head of the key furthermore has means for temporary coupling to another head of one or more other keys. Conveniently, furthermore, with said base there are associable one or more removable data plates bearing data such as identification elements of a code for the key and/or of the owner thereof.

10 Claims, 2 Drawing Sheets

TEMPORARY SUPPORT STRUCTURE, PARTICULARLY FOR EMERGENCY KEYS

BACKGROUND OF THE INVENTION

The present invention relates to a temporary support structure, particularly for emergency keys.

Numerous structures of devices adapted to allow the mutual collation of keys are currently known: among these, the use is known of a simple open metallic ring having its ends partially superimposed so as to allow, once they are elastically deformed, their insertion at a hole formed at the head of the keys.

Key-rings are furthermore known, for example, having an engagement seat for the end of an element for coupling to a small hook attached to an open eyelet having its ends partially superimposed and elastically deformable by pressure so as to allow their insertion at a hole provided in the head of the key.

All these known types of key-rings and keys have, however, some disadvantages: known key-rings are in fact bulky and have considerable weight.

Furthermore, when it is necessary to have available a copy of a single key, for example that of the house door or of the car or of the safe-deposit box, to be used in case of loss of the original, it is impossible to store the same in a pocket or in a handbag or in a wallet: in the first two cases it is in fact very difficult to find it, among the other objects or keys, in a rapid and univocal manner, while in the third case the key may easily be lost every time the wallet is inserted in, and extracted from, the pocket in which it is kept.

As a partial solution to this disadvantage, a support is known, which is produced by molding, and which is constituted by a sheet of plastic material, whereon there is provided a pair of keys, the heads whereof are connected to the sheet by means of a partially elastically deformable bridge.

Though this support allows, for example, its placement inside a wallet, it has some disadvantages: since the keys are made of plastic material and since they have a very small thickness, they are subject to breakage every time they undergo torsion, i.e. when they have to operate a lock and move a door.

The point of coupling of the head to the stem on which the notches corresponding to each individual lock are provided is in fact highly stressed, so that the use of such keys cannot be, in any case, prolonged in time, i.e. for more than a small number of applications.

Secondly, the coupling bridge between the head and the support is also subject to breakages, since the key must be removed from the sheet and rotated through approximately 180 degrees in order to be used.

Once the key is separated from the support, the latter loses its original function and therefore becomes unusable.

It is furthermore stressed that said support is obtained by molding: this means that for each type and configuration of key it is necessary to prepare a specific mold with consequent high production costs.

SUMMARY OF THE INVENTION

The aim of the object of the present application is therefore to eliminate the disadvantages described above in known types, by providing a support for one or more keys which can be stored in a wallet, handbag, pocket or similar, so as to be rapidly and selectively identifiable by its owner.

Within the above described aim, an important object is to provide a support for one or more keys which allows the optimum use of the key even for a very high number of applications, maintaining at the same time the previously mentioned characteristics.

Still another important object is to provide a support for one or more keys which associates with the preceding characteristics that of having considerable practicality in use.

Not least object is to provide a support for one or more keys which associates with the preceding characteristics that of having modest costs, being producible with known systems and machines.

The above mentioned aim and objects, as well as others which will become apparent hereinafter, are achieved by a structure of temporary support for emergency keys, comprising a head rigidly associated with a stem shaped perimetrally so as to allow the actuation of a lock, characterized in that it comprises at least one planar base having at least one seat for said key and at least one means for a temporary engagement to adapted grip elements provided at least on said head of said key.

Advantageously said head of said key has means for temporary coupling to another head of one or more keys.

Conveniently, furthermore, with said base there are associable one or more removable data plates bearing data such as identification elements of a code for said key and/or of the owner thereof.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
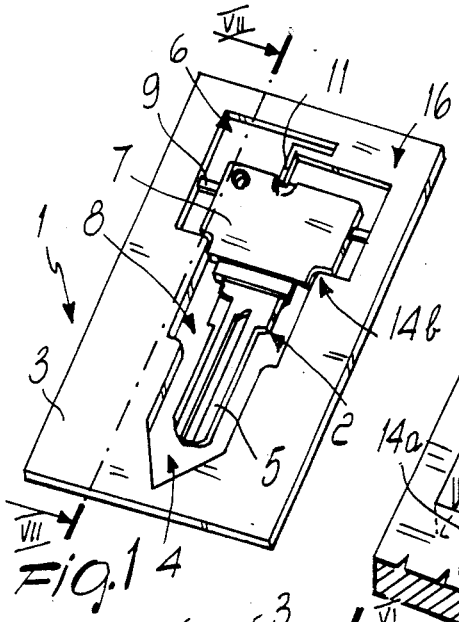
FIG. 1 is an isometric view of the support with the key associated therewith.
Figure 3:
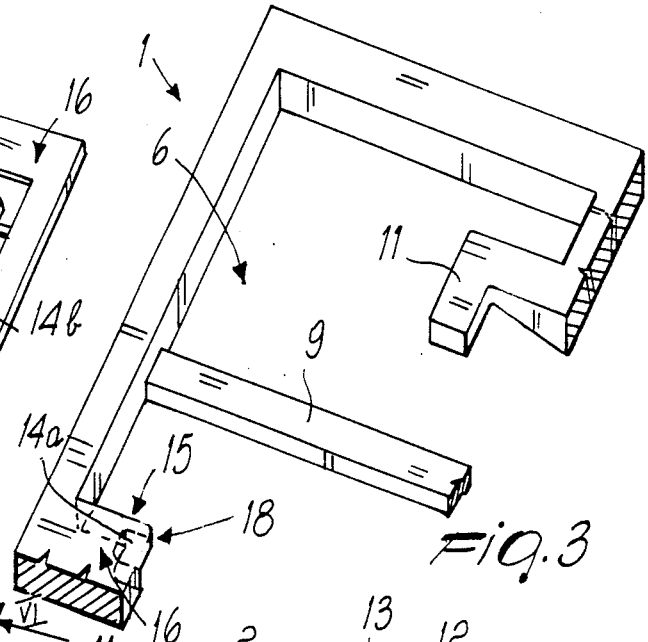
FIG. 3 is a partially sectioned detail view of the support.
Figure 2:
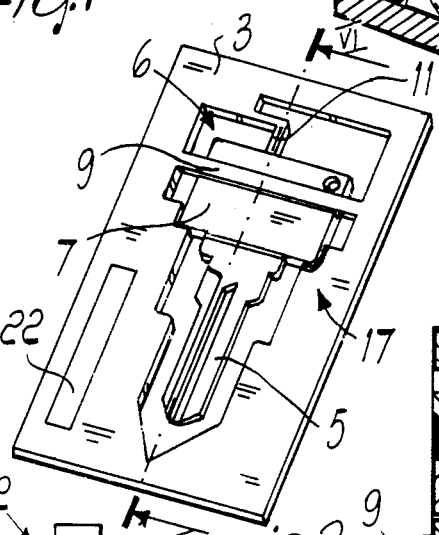
FIG. 2 is an isometric view of the opposite side of the support.
Figure 4:
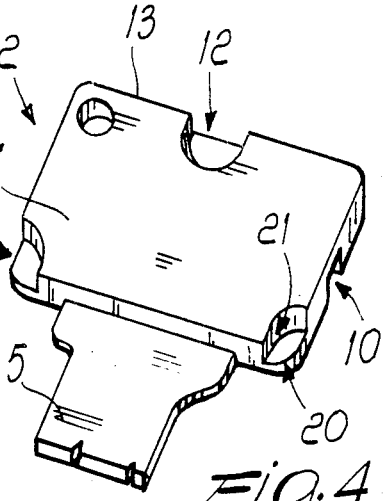
FIG. 4 is a partially sectioned isometric view of the head of the key.
Figure 5:
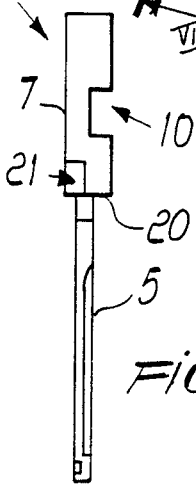
FIG. 5 is a lateral view of the key.
Figure 6:
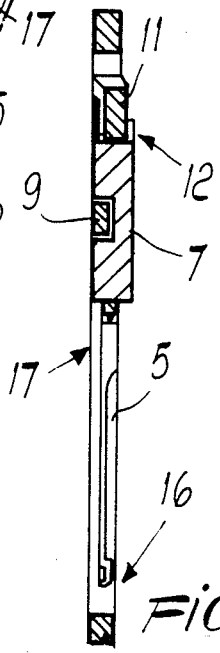
FIG. 6 is a view taken along the sectional plane VI—VI of FIG. 2.
Figure 7:
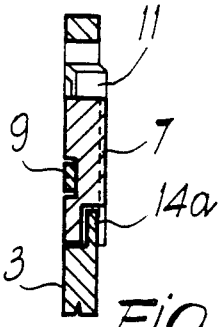
FIG. 7 is a view taken at the sectional plane VII—VII of FIG. 1.

With reference to the above described figures, the temporary support structure, generally indicated by the reference numeral 1, for keys 2, particularly of the emergency type, is constituted by at least one planar base 3 produced in plastic material.

At said base 3 there is provided at least one first through seat 4 having greater dimensions than those of the key 2, the thickness of said base 3 being approximately equal to that of the stem 5 of said key 2.

Said first seat 4 thus has a first region 6 affected by the head 7 of the key 2 and a second region 8 affected by the stem 5 of said key.

At said first region said temporary support structure has a means for hooking to the head 7 of the key 2 constituted by a crosspiece 9 having a height slightly smaller than the thickness of the base 3.

Said crosspiece 9 constitutes a hooking means for the head 7 of the key 2, on said head there being in fact provided, transversely thereto, a second seat 10 shaped complementarily to the crosspiece 9.

The structure of temporary support furthermore comprises first temporary engagement means for the head 7 of the key 2, said first temporary engagement means being constituted by an elastically deformable tab 11 protruding from said support structure approximately at the mid-longitudinal axis of said structure.

Said tab 11 interacts with an adapted grip element, provided on the head 7 of the key 2, constituted by a third seat 12 provided on said head both at the surface opposite to the one having the second seat 10 and at the longitudinal mid-axis of said key.

Said third seat 12 only partially affects the thickness of the head 7, has a preferably semicircular configuration with concavity directed towards the stem 5, and is provided at the perimetral edge 13 of the head 7.

The structure 1 furthermore has second temporary engagement means for the head 7 of the key 2, said second means being constituted by a pair of wings **14*a* and 14*b* obtained on said supporting structure at the perimetral edge 15 of the first seat 4 connecting the first region 6 and the second region 8**.

Said pair of wings **14*a* and 14*b* is arranged at the plane of the surface 16 of the base 3 opposite to the surface 17 at which the crosspiece 9** is present.

Said pair of wings **14*a* and 14*b* has a much smaller thickness than that of the supporting structure, there being provided, on the latter, a fourth seat 18 shaped complementarily to the rounded corners 19 and 20 of the head 7 adjacent to the stem 5**.

At said corners 19 and 20 of the head 7 some material is furthermore removed at the same surface in which the third seat 12 is provided to define fifth engagement seats 19 and 21 for the pair of wings **14*a* and 14*b***.

At the base 3 there are furthermore applicable or directly provideable one or more data plates 22 bearing data such as those of identification of a code for the key and/or the personal data of the owner of the key and/or any addresses to which it is to be sent in case of loss.

The use of the invention is as follows: since the key is preferably but not necessarily produced with a metallic stem 5 and a head 7 in plastic material, the user has available a key the use whereof has no problems linked to deformations of said key during its interaction with the lock.

As well as permitting optimum use of the key, which can even be of commonly commercially available type, the key can also be associated with the temporary supporting structure 1 in many manners among which the following is shown: once the base 3 is gripped, it is sufficient to place the head 7 of the key 2 at the first region 6 of the first seat 4 in a slightly inclined manner, positioning the second seat 10 at the crosspiece 9 and the third seat 12 at the tab.

Thus the key is slightly inclined, the tab 11 having to be forced to place the second seat 10 at the crosspiece 9.

Consequently, the tab 11 becomes elastically deformed and the user forces the key until the fifth seats 19 and 21 of the head 7 are positioned at the pair of wings **14*a* and 14*b***.

This having been done, the key 2 is perfectly associated with the temporary support structure 1 allowing therefore to store the same for example in a pocket or in a wallet, allowing the subsequent easy and immediate identification and retrieval thereof.

Naturally it is possible to associate the key 2 with the support structure 1 by first performing the positioning of the fifth seats 19 and 21 of the head 7 at the pair of wings **14*a* and 14*b* to then position the second seat 10 at the crosspiece 9 and then elastically deform the tab 11 to place it at the third seat 12**.

Naturally to uncouple the key 2 from the base 3 it is sufficient to operate in a sequence opposite to the one described heretofore.

It has thus been observed that the invention achieves the intended aim and objects, a supporting structure having been provided, usable for one or more keys, which can be stored for example in a wallet, a handbag, or in a pocket so that it is rapidly and selectively identifiable by its owner.

On the base 3, in fact, a plurality of seats 4 for individual keys may be provided.

It has been furthermore observed that the support allows optimum use of the key even for a very high number of applications, the key itself not being subjected to deformations of any kind.

The support structure furthermore has characteristics of considerable practicality in use, it being possible to store it together with the key for example inside a wallet.

The base may furthermore have any configuration, and the configuration of the head of the key may similarly be any.

Naturally the invention is susceptible to numerous modifications and variations, all within the scope of the same inventive concept.

Figure 8:
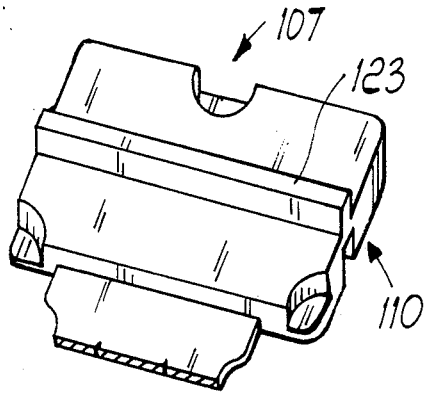
FIG. 8 is a partially sectioned isometric view of the head of a key according to a second aspect of the invention.
Figure 9:
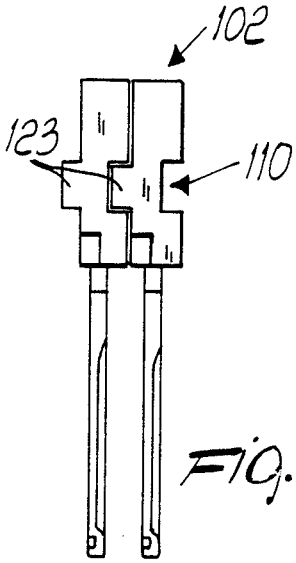
FIG. 9 is a lateral view of two coupled keys.

Thus, for example, FIGS. 8 and 9 illustrate a second embodiment for the head 107 of the key 102, the latter having, on the surface opposite to that in which the second seat 110 is provided, a transverse raised portion 123 shaped complementarily with respect to said second seat 110.

It is thus possible to mutually collate a plurality of keys simply by inserting the transverse raised portion 123 of one key at the second seat 110 of another key.

Figure 10:
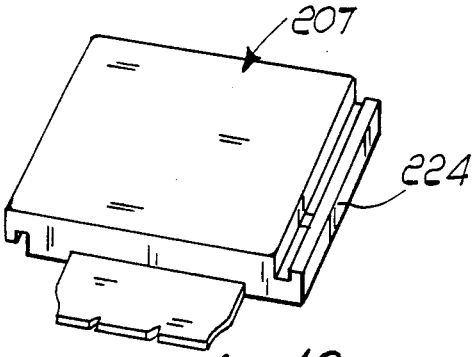
FIG. 10 is a view, similar to that of FIG. 8, of a third embodiment of the head of the key.
Figure 11:
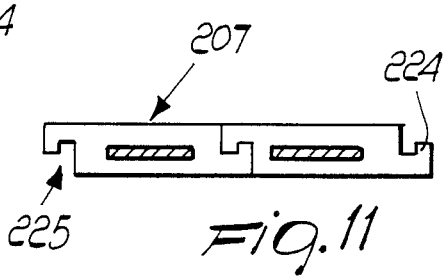
FIG. 11 is a view of two keys according to FIG. 10 coupled to one another.

FIGS. 10 and 11 illustrate a third embodiment in which on the head 207 there is provided, at a longitudinal perimetral edge, a protrusion 224 having, in a transverse cross section, an L-shaped configuration protruding perpendicularly from said perimetral edge and having a wing with smaller dimensions with respect to the thickness of said head.

At the other longitudinal edge of said head 207 there is provided a sixth seat 225 shaped complementarily with respect to said protrusion 224.

It is thus possible, as illustrated in FIG. 11, to mutually associate a plurality of keys by arranging them side by side.

Figure 12:
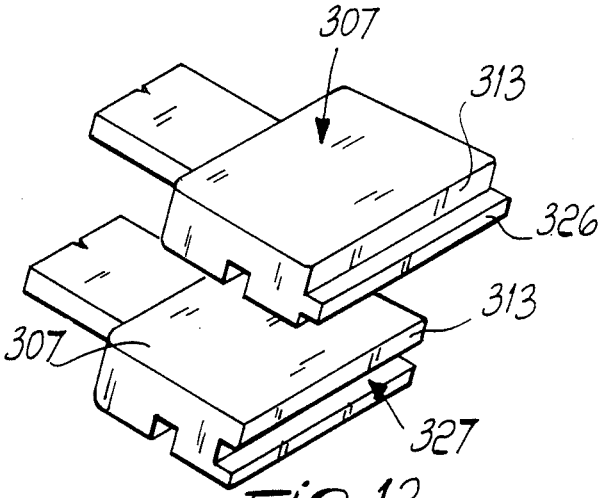
FIG. 12 is a side isometric view of the heads of two mutually associable keys.
Figure 13:
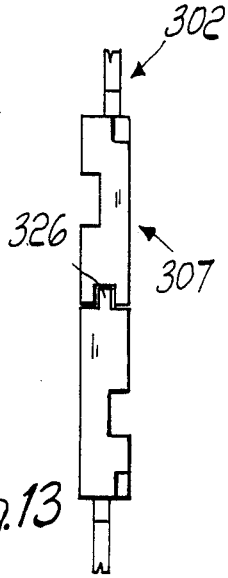
FIG. 13 is a lateral view of the keys of FIG. 12 coupled together.

FIGS. 12 and 13 illustrate a fourth embodiment of the head 307 of a key 302, which has, at the perimetral edge 313, a longitudinal raised portion 326 protruding therefrom approximately at the middle axis.

Conversely, in another key 302 there is provided, at the same perimetral edge 313 and at the middle longitudinal axis thereof, a complementarily shaped seventh seat 327.

It is thus possible to arrange the keys in an opposite manner as illustrated in FIG. 13.

Naturally, the materials and the dimensions constituting the individual components of the structure, such as for example the head and/or the stem of the key and/or the base, may also be the most suitable according to the specific requirements.

I claim:

1. Temporary support structure for emergency keys, comprising ahead rigidly associated with a stem perimetrally shaped so as to allow the actuation of a lock, and at least one planar base having at least one seat for said key and at least one means for a temporary engagement to adapted grip elements provided at least on said head of said key, wherein said at least one planar base has a means for hooking to said head of said key constituted by a crosspiece, on said head of said key there is provided, transversely thereto, a head crosspiece seat shaped complimentarily to said crosspiece.

2. Structure according to claim 1, wherein said head of said key has means for temporarily coupling to another key constituted by a transverse raised portion protruding from said head on the side opposite to said head crosspiece seat, said transverse raised portion being shaped complimentarily to said head crosspiece seat.

3. Structure according to claim 1, wherein said head of said key has means for temporarily coupling to another key constituted by a protrusion projecting perpendicularly at a longitudinal perimetral edge of said head and having in transverse cross section an L-shaped configuration with one wing having smaller dimensions with respect to the thickness of said head, on the other longitudinal perimetral edge of said head there being provided a protrusion seat shaped complimentarily to said protrusion.

4. Structure according to claim 1, wherein one of said keys has a head from which there protrudes, on the side opposite to said stem, a longitudinal raised portion, on another of said keys there being provided a longitudinal portion seat shaped complimentarily with respect to said longitudinal raised portion.

5. Temporary support for emergency keys, comprising a key provided with a head rigidly associated with a stem perimetrically shaped so as to allow the actuation of a lock, said head being provided with means for temporary coupling to at least another head of at least one key;

a planar base having at least one first through seat for the accommodation of said key, said planar base having a thickness approximately equal to that of said key, said seat having a first and a second region affected by said head and said stem of said key respectively; and a plurality of means for temporary engagement of said head to said first region, said plurality of means including a crosspiece having a height slightly smaller than the thickness of said base, said crosspiece having a surface arranged at the surface of said planar base and a second seat provided transversally on said head of said key, with said seat shaped complementarily to said crosspiece;

an elastically deformable tab protruding from said base at said first region approximately at the longitudinal mid axis of said first seat and a grip element for said tab, said grip element being constituted by a third seat provided both at the surface opposite to the surface of said second seat and at the longitudinal mid-axis of said first key at the perimetrical edge opposite to said stem, wherein said third seat has a depth smaller than the thickness of said head and a semicircular configuration with concavity directed towards said stem; and a pair of wings formed on said base at the perimetrical edge of said first seat connecting said first region to said second region, said wings being arranged at a plane of the surface of said base opposite to the surface to which said crosspiece is connected, said wings further having a thickness smaller than the thickness of said base, there being provided, on said wings, fourth seats shaped complementarily to rounded fifth seats of said head of said key adjacent to said stem, said rounded fifth seats being provided at the same surface as said third seat.

6. Temporary support for emergency keys, comprising a key provided with a head rigidly associated with a stem perimetrically shaped so as to allow the actuation of a lock, said head being provided with means for temporary coupling to at least another head of at least one key;

a planar base having at least one first through seat for the accommodation of said key, said seat having a first and a second region affected by said head and said stem of said key respectively; and a plurality of means for temporary engagement of said head to said first region, said plurality of means including a crosspiece having a height slightly smaller than the thickness of said base, said crosspiece having a surface arranged at the surface of said planar base and a second seat provided transversally on said head of said key, with said seat shaped complementarily to said crosspiece;

an elastically deformable tab protruding from said base at said first region approximately at the longitudinal mid axis of said first seat and a grip element for said tab, said grip element being constituted by a third seat provided both at the surface opposite to the surface of said second seat and at the longitudinal mid-axis of said first key at the perimetrical edge opposite to said stem, wherein said third seat has a depth smaller than the thickness of said head and a semicircular configuration with concavity directed towards said stem; and a pair of wings formed on said base at the perimetrical edge of said first seat connecting said first region to said second region, said wings being arranged at a plane of the surface of said base opposite to the surface to which said crosspiece is connected, said wings further having a thickness smaller than the thickness of said base, there being provided, on said wings, fourth seats shaped complementarily to rounded fifth seats of said head of said key adjacent to said stem, said rounded fifth seats being provided at the same surface as said third seat.

7. Temporary support for emergency keys, comprising a key provided with a head rigidly associated with a stem perimetrically shaped so as to allow the actuation of a lock, a planar base having at least one first through seat for the accommodation of said key, said seat having a first and a second region affected-by said head and said stem of said key respectively; and a plurality of means for temporary engagement of said head to said first region, said plurality of means including a crosspiece having a height slightly smaller than the thickness of said base, said crosspiece having a surface arranged at the surface of said planar base and a second seat provided transversally on said head of said key, with said seat shaped complementarily to said crosspiece;

an elastically deformable tab protruding from said base at said first region approximately at the longitudinal mid axis of said first seat and a grip element for said tab, said grip element being constituted by a third seat provided both at the surface opposite to the surface of said second seat and at the longitudinal mid-axis of said first key at the perimetrical edge opposite to said stem; and a pair of wings formed on said base at the perimetrical edge of said first seat connecting said first region to said second region, said wings being arranged at a plane of the surface of said base opposite to the surface to which said crosspiece is connected, said wings further having a thickness smaller than the thickness of said base, there being provided, on said wings, fourth seats shaped complementarily to rounded fifth seats of said head of said key adjacent to said stem, said rouned fifth seats being provided at the same surface as said third seat.

8. Temporary support for emergency keys, comprising a key provided with a head rigidly associated with a stem perimetrically shaped so as to allow the actuation of a lock, said head being provided with means for temporary coupling to at least another head of at least one further key;

a planar base having at least one first through seat for the accommodation of said key, said seat having a first and a second region affected by said head and said stem of said key respectively; and a plurality of means for temporary engagement of said head to said first region, said plurality of means including a crosspiece having a height slightly smaller than the thickness of said base, said crosspiece having a surface arranged at the surface of said planar base and a second seat provided transversally on said head of said key, with said seat shaped complementarily to said crosspiece;

an elastically deformable tab protruding form said base at said first region approximately at the longitudinally mid axis of said fist seat and a grip element for said tab, said grip element being constituted by a third seat provided both at the surface opposite to that of said second seat and at the longitudinal mid-axis of said first key at the perimetrical edge opposite to said stem, wherein said third seat has a depth smaller than the thickness of said head and a semicircular configuration with concavity directed towards said stem; and a pair of wings formed on said base at the perimetrical edge of said first seat connecting said first region to said second region, said wings being arranged at a plane of the surface of said base opposite to the surface to which said crosspiece is connected, said wings further having a thickness smaller than the thckness of said base, there being provided, on said wings, fourth seats shaped complementarily to rounded fifth seats of said head of said key adjacent to said stem, said rounded fifth seats being provided at the same surface as said third seat.

wherein said means to temporary coupling are constituted by a transverse raised portion protruding from said head on said side opposite to said second seat, said transverse portion being shaped complementarily to said second seat.

9. Temporary support for emergency keys, comprising a key provided with a head rigidly associated with a stem perimetrically shaped so as to allow the actuation of a lock, said head being provided with means for temporary coupling to at least another head of at least one further key;

a planar base having at least one first through seat for the accommodation of said key, said planar base having a thickness approximately equal to the thickness of said key, said seat having a first and a second region affected by said head and said stem of said key respectively; and a plurality of means for temporary engagement of said head to said first region, wherein said means for temporary coupling are constituted by a protrusion, projecting perpendicularly at a longitudinal perimetric edge of said head of said key and having in transverse cross section an L-shaped configuration with one wing having smaller dimensions with respect to the thickness of said head, on the other longitudinal perimetrical edge of said head there being provided a sixth seat shaped complementarily to said protrusion.

10. Temporary support for emergency keys, comprising a key provided with ahead rigidly associated with a stem perimetrically shaped so as to allow the actuation of a lock, said head being provided with means for temporary coupling to at least another head of at least one further key;

a planar base having at least one first through seat for the accommodation of said key, said planar base having a thickness approximately equal to the thickness of said key, said seat having a first and a second region affected by said head and said stem of said key respectively; and a plurality of means for temporary engagement of said head to said first region, wherein said means for temporary coupling are constituted by a longitudinal raised portion on the head of said key on the side opposite to said stem which protrudes into a seventh seat on the head of said further key, said seventh seat being complementarily shaped with respect to said longitudinal portion.

* * * * *